US008776889B2

(12) United States Patent
Smith et al.

(10) Patent No.: US 8,776,889 B2
(45) Date of Patent: Jul. 15, 2014

(54) IRREGULARLY SHAPED FLAPPER CLOSURE AND SEALING SURFACES

(75) Inventors: Roddie R. Smith, Cypress, TX (US); Serge Garay, Osserain (FR)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 12/836,143

(22) Filed: Jul. 14, 2010

(65) Prior Publication Data

US 2012/0012202 A1 Jan. 19, 2012

(51) Int. Cl.

| | |
|---|---|
| ***E21B 33/06*** | (2006.01) |
| ***F16K 1/24*** | (2006.01) |
| ***F16K 15/03*** | (2006.01) |

(52) U.S. Cl.

USPC ..... 166/332.8; 166/334.1; 251/298; 137/527

(58) Field of Classification Search

USPC ..... 166/332.1, 332.8, 334.1, 332.7; 251/298, 332, 359; 137/527, 527.8

See application file for complete search history.

(56) References Cited

U.S. PATENT DOCUMENTS

| | | | | | |
|---|---|---|---|---|---|
| 1,068,303 | A | * | 7/1913 | Bohlander | 137/527.8 |
| 4,134,455 | A | * | 1/1979 | Read | 166/334.1 |
| 4,228,917 | A | * | 10/1980 | Sowell | 220/378 |
| 4,228,987 | A | * | 10/1980 | Potter | 251/210 |
| 4,471,499 | A | * | 9/1984 | Troman et al. | 4/393 |
| 4,512,359 | A | * | 4/1985 | Hinojosa et al. | 137/315.32 |
| 4,531,587 | A | * | 7/1985 | Fineberg | 166/332.8 |
| 4,624,315 | A | | 11/1986 | Dickson et al. | |
| 4,723,606 | A | | 2/1988 | Vinzant et al. | |
| 4,945,993 | A | | 8/1990 | Dickson et al. | |
| 5,044,443 | A | | 9/1991 | Churchman et al. | |
| 5,094,266 | A | * | 3/1992 | Ledbetter | 137/469 |
| 5,125,457 | A | * | 6/1992 | Meaders | 166/322 |
| 5,137,089 | A | | 8/1992 | Smith et al. | |
| 5,284,205 | A | | 2/1994 | Smith | |
| 5,323,859 | A | * | 6/1994 | Smith et al. | 166/321 |
| 5,411,096 | A | | 5/1995 | Akkerman | |
| 5,823,265 | A | * | 10/1998 | Crow et al. | 166/373 |
| 5,862,864 | A | * | 1/1999 | Whiteford | 166/321 |

(Continued)

FOREIGN PATENT DOCUMENTS

WO 2009060233 A1 5/2009

OTHER PUBLICATIONS

Rectilinear. 2011. Merriam-Webster.com. Retrieved Aug. 25, 2011, from http://www.merriam-webster.com/dictionary/rectilinear.*

(Continued)

*Primary Examiner* — Shane Bomar
*Assistant Examiner* — Wei Wang
(74) *Attorney, Agent, or Firm* — Wong, Cabello, Lutsch, Rutherford & Brucculeri, LLP

(57) ABSTRACT

A flapper valve for a surface controlled, sub-surface safety valve has a seat and a curved flapper. The seat has a seating rim, and the curved flapper has a sealing rim and can pivot relative to the seat. The flapper's sealing rim corresponds in shape to the seating rim. Both rims have lobes disposed outside a circular perimeter. Also, the undulating edges of the rims have corresponding outcroppings and incroppings. When a flow tube moves towards or away from the flapper, the flapper's lobes protect the flapper's sealing rim as the flapper's inside surface engages the moving flow tube. Moreover, the rims can have a groove and a ridge that engage one another when the rims close.

28 Claims, 10 Drawing Sheets

(56) References Cited

U.S. PATENT DOCUMENTS

| | | | | |
|---|---|---|---|---|
| 5,918,858 | A * | 7/1999 | Rawson et al. | 251/359 |
| 6,227,299 | B1 * | 5/2001 | Dennistoun | 166/332.8 |
| 6,315,047 | B1 * | 11/2001 | Deaton et al. | 166/319 |
| 6,328,109 | B1 * | 12/2001 | Pringle et al. | 166/373 |
| 6,425,413 | B2 * | 7/2002 | Davis et al. | 137/527 |
| 6,523,614 | B2 | 2/2003 | Dennistoun et al. | |
| 6,648,075 | B2 | 11/2003 | Badrak et al. | |
| 6,659,185 | B2 | 12/2003 | Dennistoun et al. | |
| 6,742,595 | B2 | 6/2004 | Dennistoun et al. | |
| 6,772,842 | B2 * | 8/2004 | Read et al. | 166/332.8 |
| 6,808,020 | B2 * | 10/2004 | Garcia et al. | 166/373 |
| 6,854,519 | B2 | 2/2005 | Deaton et al. | |
| 6,880,641 | B2 | 4/2005 | Dennistoun et al. | |
| 6,892,997 | B2 | 5/2005 | Kreuter | |
| 6,920,934 | B2 | 7/2005 | Badrak et al. | |
| 6,953,093 | B2 | 10/2005 | Dennistoun et al. | |
| 7,032,672 | B2 | 4/2006 | Dennistoun et al. | |
| 7,048,065 | B2 | 5/2006 | Badrak et al. | |
| 7,178,599 | B2 | 2/2007 | Anderson et al. | |
| 7,246,668 | B2 | 7/2007 | Smith | |
| 7,249,635 | B2 | 7/2007 | Dennistoun et al. | |
| 7,299,880 | B2 * | 11/2007 | Logiudice et al. | 166/381 |
| 7,314,091 | B2 | 1/2008 | Wagner et al. | |
| 7,392,849 | B2 | 7/2008 | Lauderdale et al. | |
| 7,475,733 | B2 | 1/2009 | Dennistoun et al. | |
| 7,537,062 | B2 * | 5/2009 | Hughes et al. | 166/386 |
| 7,543,651 | B2 | 6/2009 | Smith et al. | |
| 7,654,333 | B2 | 2/2010 | Smith | |
| 7,708,066 | B2 * | 5/2010 | Frazier | 166/250.08 |
| 7,798,229 | B2 * | 9/2010 | Vick et al. | 166/332.8 |
| 8,261,836 | B2 * | 9/2012 | Noske et al. | 166/332.8 |
| 2002/0083975 | A1 * | 7/2002 | Chaffee | 137/223 |
| 2002/0084076 | A1 * | 7/2002 | Ives | 166/324 |
| 2003/0079880 | A1 * | 5/2003 | Deaton et al. | 166/332.8 |
| 2003/0121664 | A1 * | 7/2003 | Hill et al. | 166/332.8 |
| 2004/0000407 | A1 * | 1/2004 | Hernandez et al. | 166/386 |
| 2006/0011354 | A1 * | 1/2006 | Logiudice et al. | 166/380 |
| 2008/0035353 | A1 * | 2/2008 | Hughes et al. | 166/386 |
| 2009/0056951 | A1 * | 3/2009 | Mosher et al. | 166/373 |

OTHER PUBLICATIONS

Weatherford, "Tubing-Retrievable Subsurface Safety Valves: Product Selection." (c) 2005.

Weatherford, "Optimax Wireline-Retrievable Subsurface Safety Valve Model WDB." (c) 2006-2009, 3 pages.

Weatherford, "Optimax Wireline—Retrievable Subsurface Safety Valve Model WCS." (c)2006-2009, 2 pages.

First Office Action in counterpart Canadian Appl. No. 2,741,287, dated Oct. 17, 2012.

First Examination Report in Australian Appl. 2011202433, dated Nov. 10, 2012.

Second Office Action in counterpart Canadian Appl. No. 2,741,287, dated Aug. 5, 2013.

European Search Report issued in EP Application No. EP11167655.7 dated Feb. 14, 2014, 4 pages.

* cited by examiner

IRREGULARLY SHAPED FLAPPER CLOSURE AND SEALING SURFACES

BACKGROUND

Surface-controlled, subsurface safety valves (SCSSVs) are commonly used to shut-in oil and gas wells. The SCSSV fits onto production tubing in a well and operates to block flow of formation fluid upwardly through the tubing should a failure or hazardous condition occur at the well surface. The SCSSV can be tubing retrievable and rigidly connected to the production tubing (tubing retrievable), or it can be wireline retrievable and installed and retrieved by wireline without disturbing the production tubing.

Most SCSSVs are "normally closed" and use a flapper type closure mechanism biased to a closed position. A hydraulic actuator can be moved longitudinally in the SCSSV to overcome the flapper's bias and open the valve. Typically, the actuator uses a piston and a flow tube.

During normal production, hydraulic pressure transmitted to the piston moves the flow tube longitudinally in the valve to keep the flapper open. The hydraulic pressure is commonly supplied by a control line run along the annulus between the production tubing and casing. When a hazardous condition occurs, the SCSSV provides automatic shutoff of the production flow. The hazardous condition can be sensed and/or indicated at the surface or elsewhere and can include a fire on the platform, a high/low flow line pressure condition, a high/low flow line temperature condition, operator override, or the like.

Once the condition is sensed or indicated, the hydraulic pressure is removed from the control line, and the loss of hydraulic pressure causes the flapper to close and block the flow of production fluids up the tubing. When the flapper closes (as well as opens), the flapper's mating surface engages with the flow tube. In fact, the conventional flapper has a concentrated area on its inside surface that engages with the flow tube as they both moving during closing (or opening). This area and even the flapper's sealing surface can be damaged or deformed during harsh opening and closing operations.

The direct solution to address the problem of damage to the flapper simply involves limiting the flow level for which the flapper mechanism is rated. Alternatively, the flapper's thickness can be increased to make it more robust, but this reduces the cross-sectional flow area that can pass through the valve. In any event, operators strive for valves providing as much flow area as possible when open and capable of operating in high working pressures. When operators need a valve with a very slim diameter, such as 7-in., addressing problems with damage to the flapper becomes even more problematic.

The subject matter of the present disclosure is directed to overcoming, or at least reducing the effects of, one or more of the problems set forth above.

SUMMARY

A flapper valve for a downhole tool, such as a surface controlled sub-surface safety valve, has a seat and a flapper. The seat has a seating rim and can be dispose in a housing's tubular bore. The flapper can pivot at a proximal end relative to the seat. The flapper has a sealing rim that corresponds in shape to the seating rim so that the two rims seal when mated together.

In particular, the seating rim defines a first perimeter conforming to a circular profile, but the seating rim has an irregular shape having first lobes disposed outside the first perimeter. The flapper's sealing rim defines a second perimeter conforming to the first perimeter of the seating rim. The sealing rim also has second lobes disposed outside the second perimeter and disposed on either side of the flapper's proximal end about which it pivots.

A flow tube of the downhole tool can move relative to the seat and the flapper. A biasing member biases this flow tube away from the flapper so that the flapper can close. However, a hydraulically actuated piston pushes the flow tube toward the flapper to open it when the piston is activated.

When the flow tube moves away from the flapper, the flapper closes transverse to the tubular bore and engages the seat. When the flow tube moves towards the flapper, the flapper fits in a space between the flow tube and the tubular bore of the housing. In either case, the second lobes protect the flapper's sealing rim as the flapper's inside surface engages the moving flow tube.

The flapper can be a curved flapper, a flat flapper, or a combination thereof, and the teachings of the present disclosure can apply to a flapper of any shape flapper, whether flat or curved. For example, when the flapper is curved or flat, the lobes on the flapper can help protect its sealing rim when engaged by the moving flow tube. When the flapper has a curved body, both the sealing and seating rims have an irregular contour in addition to the irregular perimeters with lobes. In this instance, the seat's rim defines a first edge undulating transversely about the first perimeter. Similarly, the flapper's rim defines a second edge undulating transversely about the second perimeter. At the first lobes, the seating rim defines outcroppings that deviate outwardly from the transverse undulation of the first edge. The flapper's sealing rim defines incroppings at the second lobes that deviate inwardly from the transverse undulation of the second edge.

As an alternative or in addition to the irregular perimeter and contour, the sealing and seating rims of the flapper valve can have a groove and a ridge disposed at least partially thereabout. For example, the seating rim can have the groove disposed at least partially thereabout, while the sealing rim can have the ridge disposed at least partially thereabout. The groove and ridge can define triangular cross-sections, rectilinear cross-sections, or a combination of these. When the sealing rim engages the seating rim as the flapper closes on the seat, the ridge engages or fits in the groove to hold the flapper's rim in place. Use of the grooves and ridges can be beneficial to any shaped flapper, whether flat, curved, or combination thereof.

The foregoing summary is not intended to summarize each potential embodiment or every aspect of the present disclosure.

DETAILED DESCRIPTION

Figure 1:
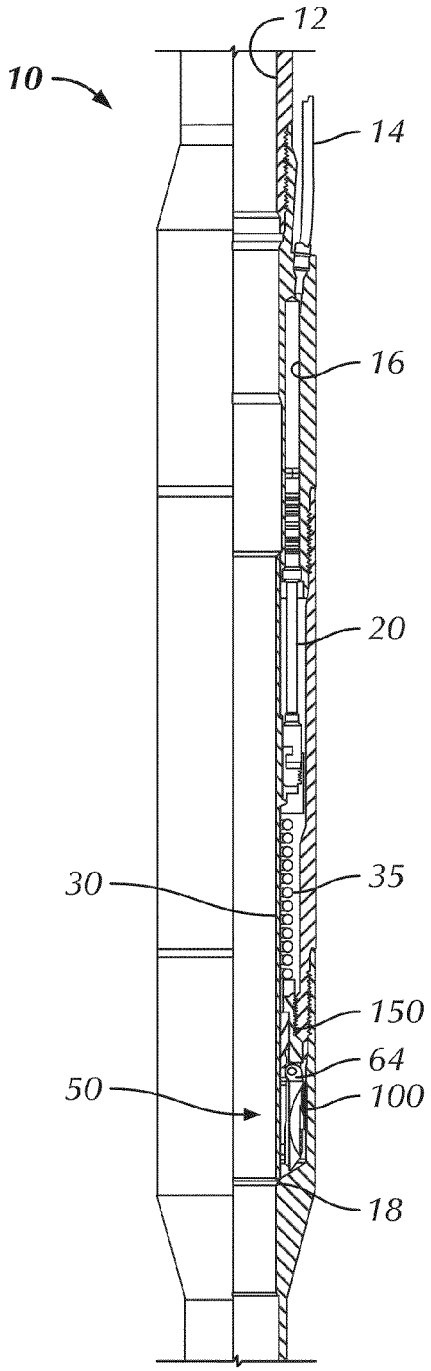
FIG. 1 is a partial cross-section of a downhole tool having a flapper valve according to the present disclosure.
Figure 2A:
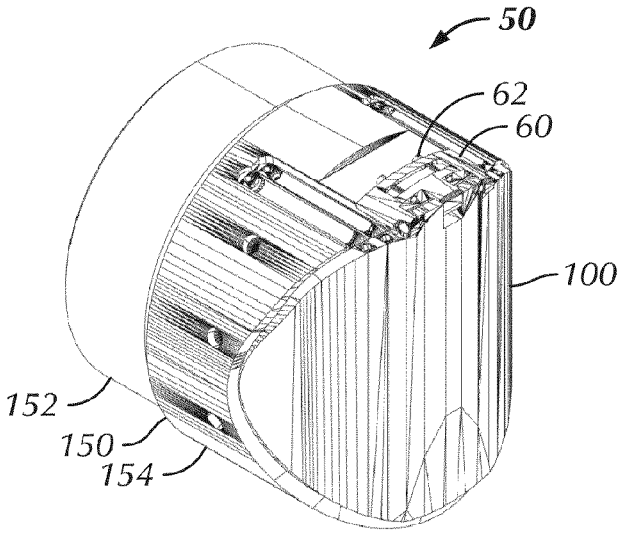
FIGS. 2A-2B are isolated perspective views of the flapper valve according to the present disclosure.
Figure 2B:
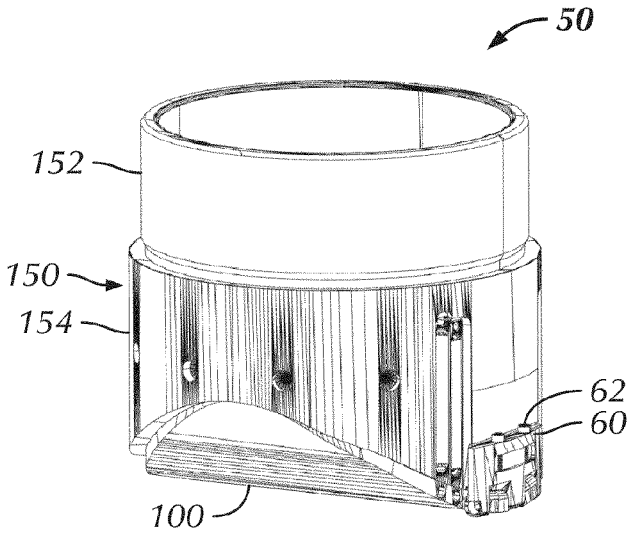

FIG. 1 shows a partial cross-section of a downhole tool 10 having a flapper valve 50 according to the present disclosure. The tool 10 can be a surface-controlled, subsurface safety valve (SCSSV) for shutting-in a well. As such, the tool 10 can fit into or onto production tubing (not shown) in the well and can operate to block flow of formation fluid through the production tubing should a failure or hazardous condition occur. The flapper valve 50 can also be used in other downhole tools, such as a downhole deployment valve (DDV), a downhole control valve (DCV), or other downhole valve or closure.

The tool 10 has a through-bore 12 for passage of production fluid. A control line 14 from the surface supplies hydraulic fluid to a chamber 16 in the tool 10, and hydraulic pressure in the chamber 16 moves a piston 20 against the bias of a spring 35. Coupled to this piston 20, a flow tube 30 moves in the tool's through-bore 12. When moved downward in the tool 10 as shown in FIG. 1, the flow tube 30 opens the flapper valve 50 by pivoting a flapper 100 away from a seat 150. As a result, the flapper 100 fits in an annular space 18 between the flow tube 30 and the tool's housing. In this position, the flow tube 30 helps convey production fluids through the tool 10 while protecting the flapper valve 50.

During well production, the flapper 100 is maintained open by hydraulic pressure applied to the piston 20, which moves the flow tube 30 against the bias of the spring 35 to open the flapper 100. Any loss of hydraulic pressure at the control line 14 causes the piston 20 and actuated flow tube 30 to retract. This causes the flapper 100 to return to its normally closed position. When hydraulic pressure is released from the line 14, for example, the spring 35 biases the piston 20 and flow tube 30 upward in the through-bore 12. Freed, the flapper 100 pivots on a hinged connection to the seat 150 by a torsion spring (64; FIG. 1) or the like until the flapper 100 seals against the seat 150 and closes flow up through the tool's bore 12.

Figure 3A:
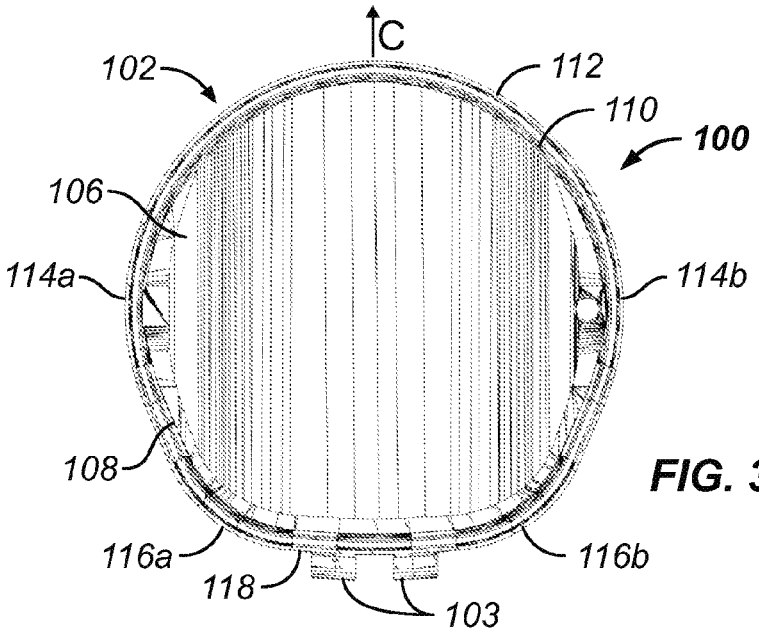
FIGS. 3A-3F show top, distal end, back, proximal end, right, and left views of the flapper.
Figure 3B:
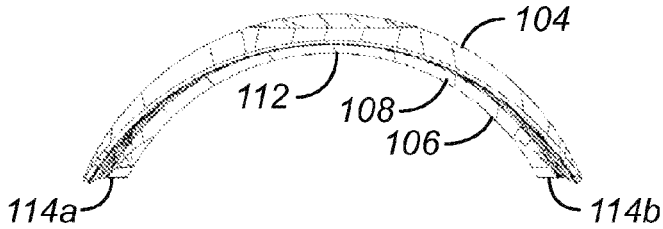
Figure 3C:
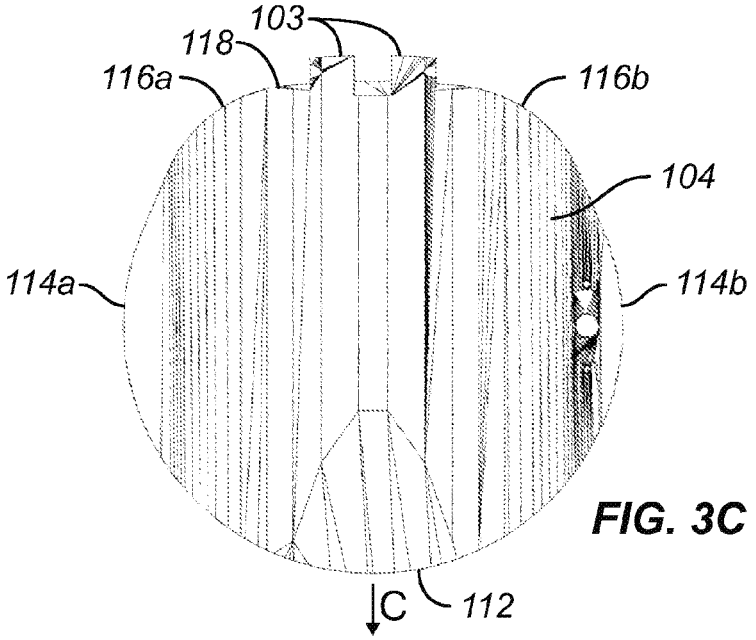
Figure 3D:
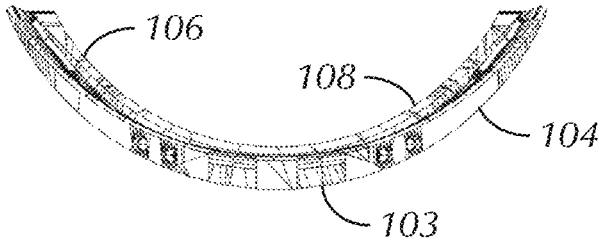
Figure 3E:
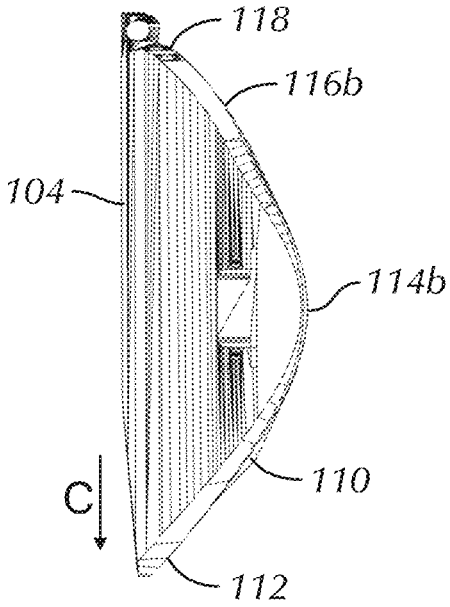
Figure 3F:
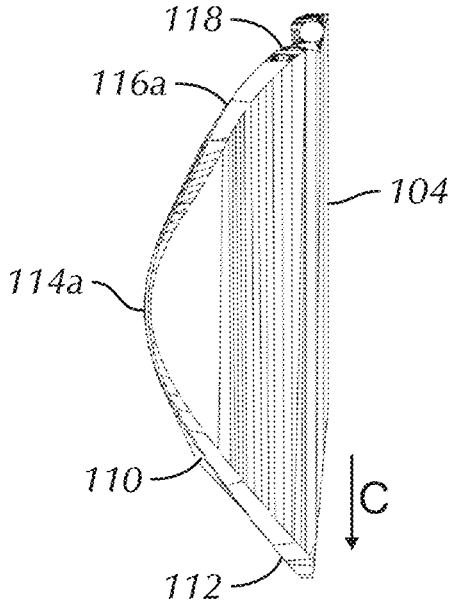

For reference, FIGS. 3A-3B show the flapper valve 50 in a closed condition. The seat 150 has a narrow end 152 and a widened end 154 and fits inside the tool's housing. The flapper 100 connects to the seat 150 with a hinge bracket 60 on the widened end 154 using fasteners 62. When closed, the flapper 100 covers the seat 150 and blocks flow therethrough.

Depending on the reasons for closing, the movement of the flow tube 30 and pivoting of the flapper 100 can be quite sudden and hard. Therefore, the components are made to withstand hard closings. Yet, as the flow tube 30 moves and frees the flapper 100 to pivot, the flow tube 30 tends to rub along the top or inside surface of the flapper 100. Because the flapper 100 is curved, the flow tube 30 can damage various areas of the inside surface and even jeopardize the resultant seal that can be achieved with the flapper 100, especially when the flapper valve 50 undergoes several hard closures. The same problems can occur when opening the flapper 100. As the flow tube 30 forces the flapper 100 open, it tends to ride along the inside surface, which can cause damage.

The flapper valve 50 of the present disclosure addresses this type of damage. As detailed below, the flapper 100 and seat 150 have irregular shapes that are different than what is conventionally used in the art. At the same time, the flapper valve 50 can maintain the flow area through the tool 10. In this way, the flapper valve 50 can address damage to the flapper 100 while accounting for the scarcity of space in the downhole tool 10 and not decreasing the flow area through the tool 10.

As shown in FIGS. 3A-3F, the flapper 100 has a curved body 102 that allows the flapper 100 to take the cylindrical profile of the tool's annular space (18) around the flow tube (30) when open. (See FIG. 1.) This allows the tool 10 to remain slim while maximizing the flow area possible through the tool's bore 12. In an alternative arrangement, the flapper 100 can have a flat body or at least a flat outside surface 104. In this instance, the tool 10 may require a side pocket area for the flapper 100 to fit when pivoted open.

The flapper's body 102 has a bottom or outside surface 104 (shown in FIG. 3C) that closes off the downhole portion of the tool (10) when the flapper 100 is closed across the seat (150). The top or inside surface 106 (shown in FIG. 3A) sits against the seat 150 when closed. During opening and closing of the flapper 100, the flow tube (30) engages this surface 106. Therefore, this surface 106 is where damage can occur due to hard opening and closings of the flapper 100.

As best shown in FIG. 3A, the flapper's inside surface 106 has a central ledge 108 circumscribed by a sealing rim 110. Because the flapper's body 102 closes across the cylindrical bore (12) of the tool (10), the profile of the flapper's body 102 is generally circular. Because the flapper's body 102 is cylindrically curved, the sealing rim 110 has a transverse undulating shape. This means that the flapper's edges 114*a-b* transverse to a centerline C undulate or fold inward at a different elevation than the edges 112/118 at the centerline C. As a result, the edges of the sealing rim 110 have a generally sinusoidal contour around the flapper 100.

Yet, the contour of the flapper's edge and the profile of its perimeter are irregular to protect the inside surface 106 from damage by the flow tube (30) during hard openings and closings. As best seen in FIGS. 3B, 3D, 3E & 3F, the rim's distal edge 112 extending to the transverse edges 114*a-b* follows a sinusoidal contour. However, the rim's contour from the transverse edges 114*a-b* to the proximal edge 118 deviates from sinusoidal and has outcropped deviations 116*a-b*. (The contour of these outcropped deviations 116*a-b* relative to a sinusoidal contour is best shown in the diagram of FIG. 4B.)

Figure 4A:
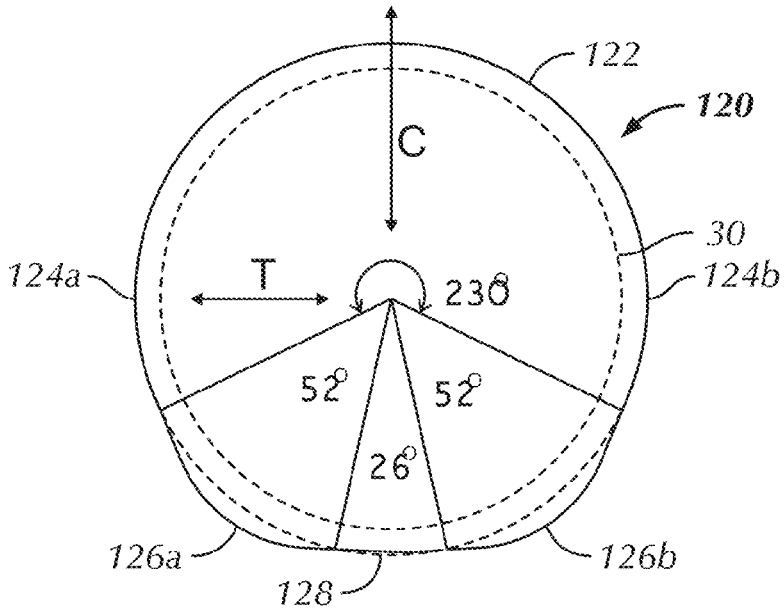
FIG. 4A diagrams a plan view of the flapper's perimeter.
Figure 4B:
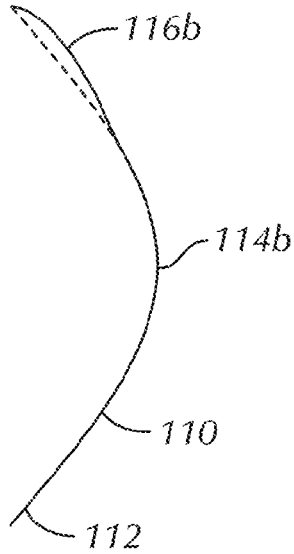
FIG. 4B diagrams a side view of the flapper's edge.

As best seen in the diagram of FIG. 4A, the distal perimeter 122 extending to the transverse perimeters 124*a-b* towards ends of transverse line T (which roughly separates the rim's distal and proximal ends) conforms to a circle. However, the rim's profile from the transverse perimeters 124*a-b* to the proximal perimeter 128 deviates from circular and has outcropped lobes 126*a-b*. Between these lobes 126*a-b*, the proximal perimeter 128 is generally straight where the hinges 103 connect, and the perimeter 128 lies within the general circular profile of the rim's circular perimeter 120. In general, the angles for the arc from the distal perimeter 122 to the transverse perimeters 124*a-b*, the arc for the lobes 126*a-b*, and the arc for the straight perimeter 128 can vary depending on the implementation. Additionally, the angles for the arcs can depend on the overall diameter of the tool and other factors. In one arrangement, for example, the tool can have an overall diameter of 7-inches. For this arrangement, the distal perimeter 122 to the transverse perimeters 124*a-b* can encompass an arc of about 230-degrees, while the lobes 126*a-b* can encompass arcs of about 52-degrees each. This leaves an arc of about 26-degrees for the straight, back perimeter 128. Again, these values are exemplary and can vary depending on the implementation.

Figure 4D:
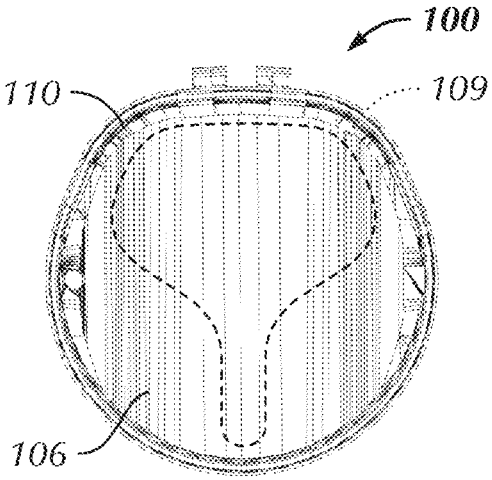
FIG. 4D is a plan view of the flapper's inside surface.
Figure 4C:
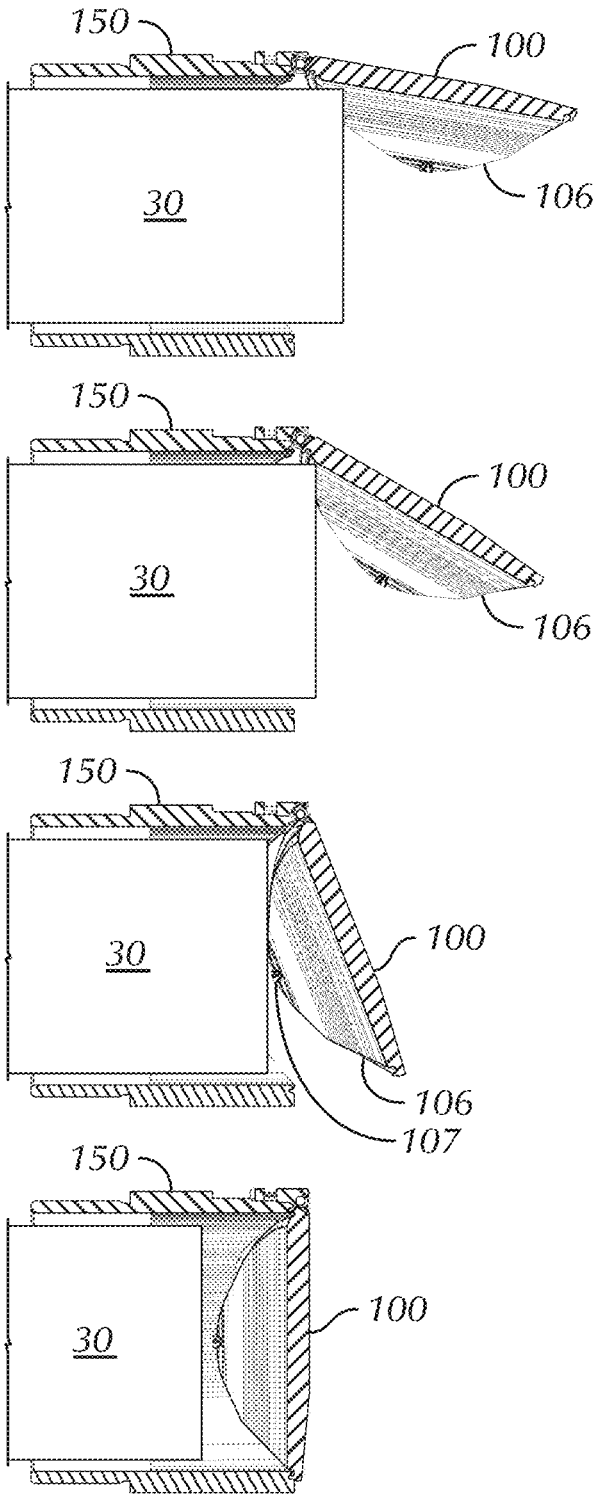
FIG. 4C shows a closing operation of the flapper valve.
Figure 4E:
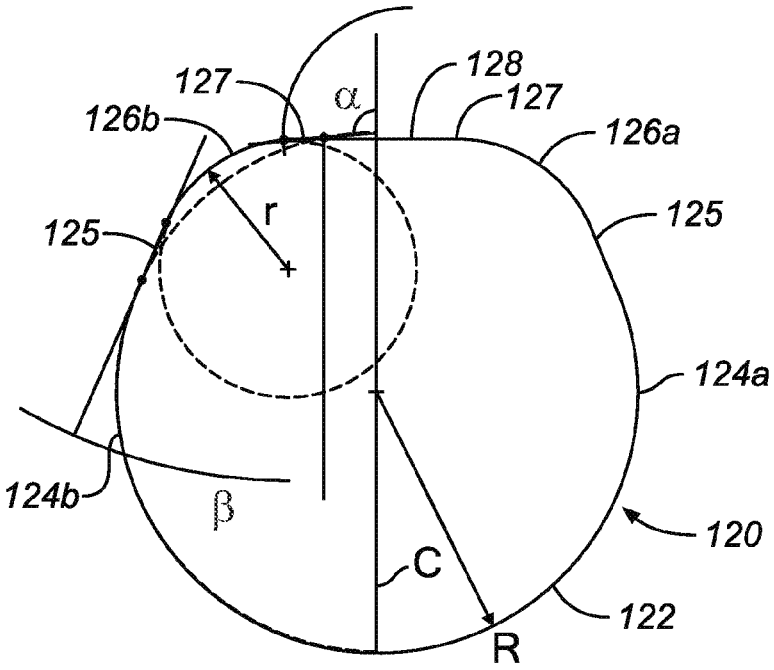
FIG. 4E diagrams another plan view of the flapper's perimeter.
Figure 4F:
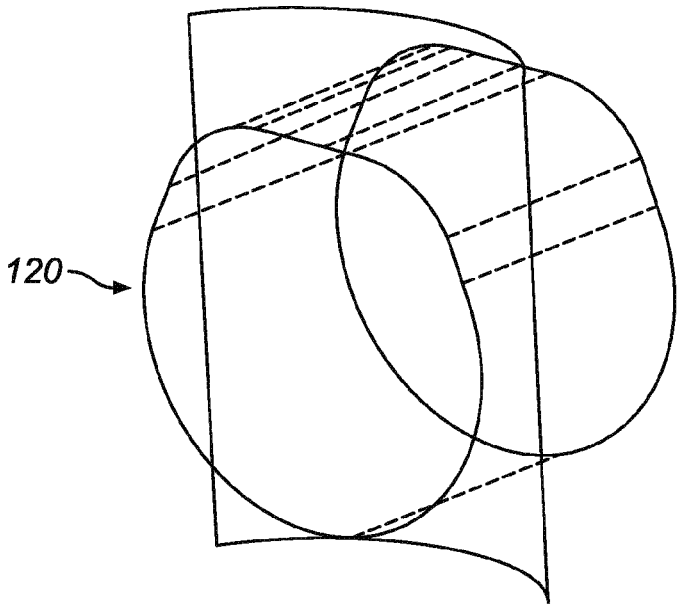
FIG. 4F shows the flapper's perimeter projected onto a curved plane.

FIGS. 4E-4F show additional details of one arrangement for the flapper's perimeter 120. As shown in FIG. 4E, the distal perimeter 122 to the transverse perimeters 124*a-b* toward ends of the transverse line T defines a contour having a large radius R. Intermediate perimeters 125 between the transverse perimeters 124*a-b* and the lobes 126*a-b* define lines at an angle β relative to the flapper's centerline C. The lobes 126*a-b* themselves define a contour with a smaller radius R offset from the flapper's center. Between the lobes 126*a-b* and the back perimeter 128, transition perimeters 127 define lines at an angle α relative to the flapper's centerline C.

In one implementation, the angle β can be about 23-degrees, while the angle α can be about 95-degrees. Yet, the various dimensions (especially large radius R and length of the sections of the perimeter) for the flapper can vary depending on the implementation. FIG. 4F shows how flapper's perimeter 120 is projected onto a curved plane so that the flapper's rim has the transverse undulating shape described herein.

Figure 5A:
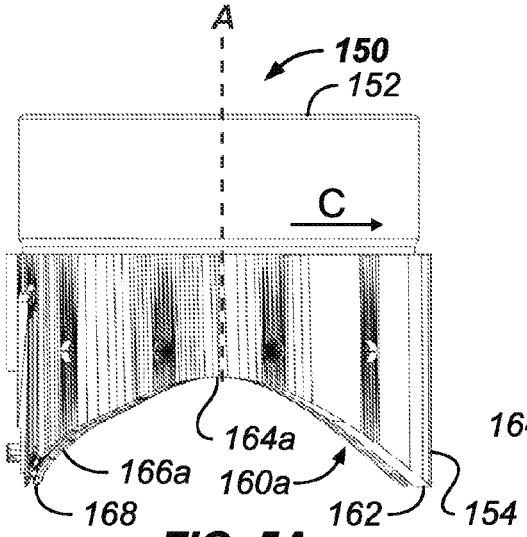
FIGS. 5A-5F show left, front, right, back, top, and bottom views of the seat.
Figure 5B:
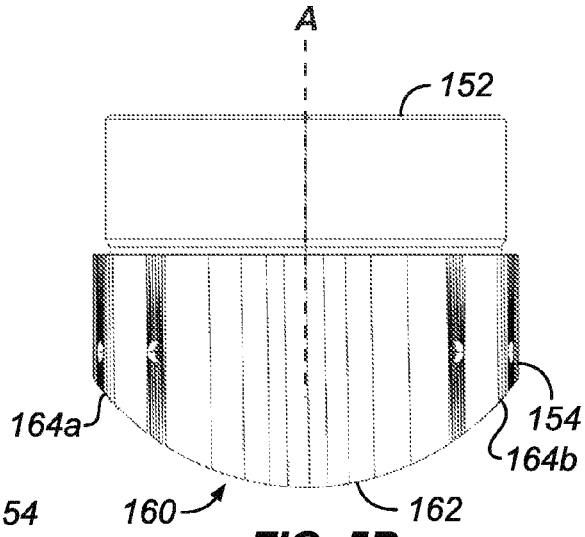
Figure 5C:
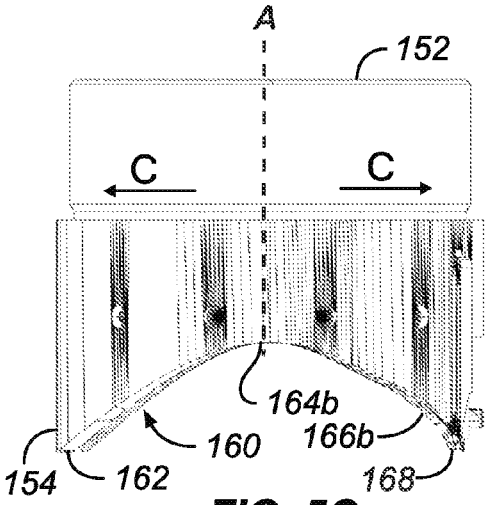
Figure 5D:
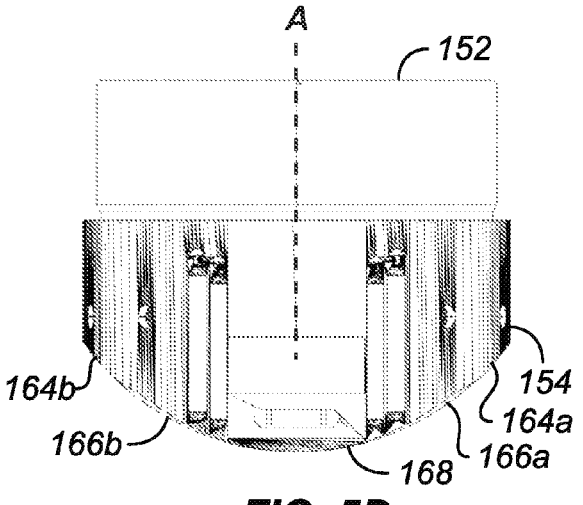
Figure 5E:
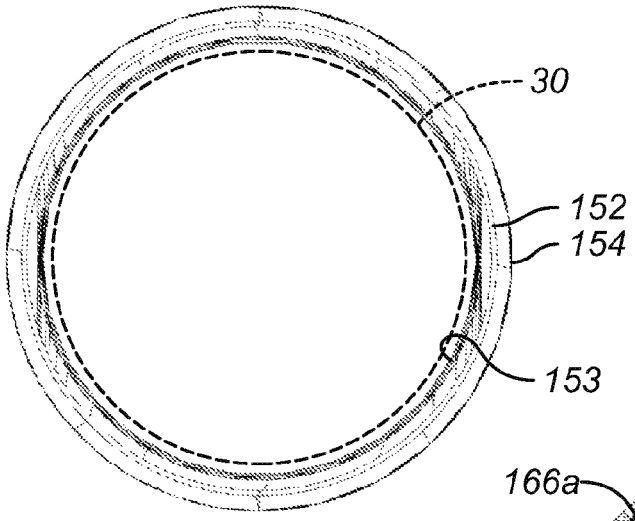
Figure 5F:
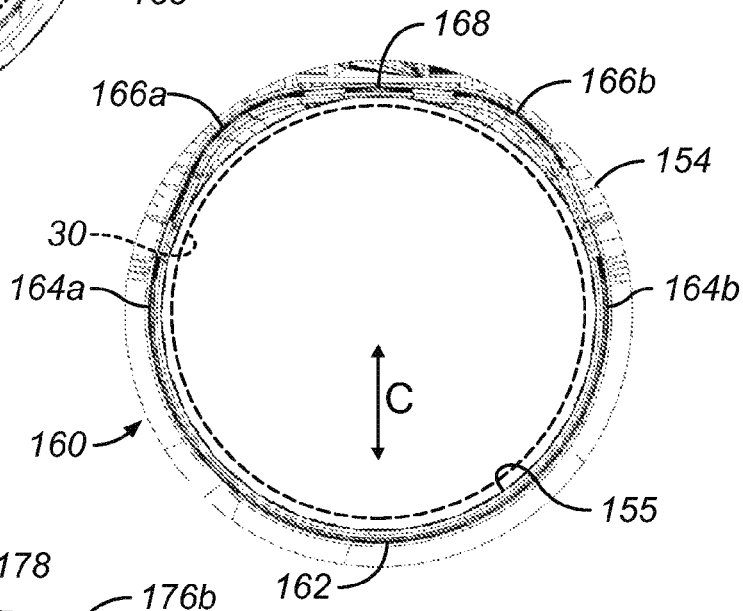

As shown in FIGS. 5A-5F and noted previously, the seat 150 has a narrow portion 152 and a widened portion 154. Both are generally cylindrical. In fact, as best shown in FIG. 5E, the narrow portion 152 is cylindrical and has a cylindrical bore 153 for passage of the flow tube (30) therein. As shown in FIG. 5F, the widened portion 154 is also cylindrical and has a cylindrical bore 155 for passage of the flow tube (30) therein.

Because the perimeter 120 of the flapper's rim 110 is irregularly shaped with the lobes 126*a-b*, the perimeter 170 of the seat's rim 160 is complementarily shaped. Likewise, to accommodate the irregular perimeter's 120/170, the edge contours of the seating rim 160 deviate from the typically smooth transverse undulating contour that is generally sinusoidal.

As shown in FIGS. 5A-5D, the seating rim 160 has an edge contour that mirrors the sealing rim 110 of the flapper 100 described previously. In this way, the two rims 110/160 can mate with one another to form a seal when the flapper 100 is closed against the seat 150. Accordingly, the seating rim 160 has a transverse undulating contour with the seat's edges 164*a-b* transverse to a centerline C undulate or fold inward at a different elevation than the edges 162/168 at the centerline C. As a result, the edges of the seating rim 160 are generally sinusoidal around the seat 150.

Figure 6B:
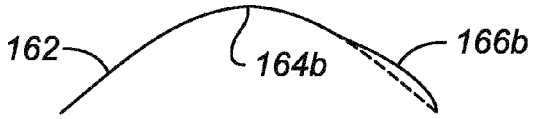
FIG. 6B diagrams a side view of the seat's edge.

In fact, as seen in FIGS. 5A-5C, the rim's distal edge 162 extending to the transverse edges 164*a-b* follows a sinusoidal contour. However, the rim's contour from the transverse edges 164*a-b* to the proximal edge 168 deviates from sinusoidal and has incropped deviations 166*a-b*. (The contour of these incropped deviations 166*a-b* relative to a sinusoidal contour is shown in FIG. 6B.)

As visible in FIGS. 5A-5D, portions of the seating rim 160 at the transverse edges 164*a-b* and distal and proximal edges 162/168 are roughly perpendicular to an axis A passing through the seat 150. However, portions (e.g., at 166*a-b*) of the seating rim 160 between the transverse edges 164*a-b* and distal and proximal edges 162/168 angle outward. In an opposite fashion, areas of the sealing rim 110 at the edges 122/124*a-b*/126 of the flapper 110 are roughly perpendicular as visible in FIGS. 3A-3F, while the areas (e.g., at 116*a-b*) between the edges 122/124*a-b*/-128 on the flapper 100 angle inward. Other angular configurations are possible.

Figure 6A:
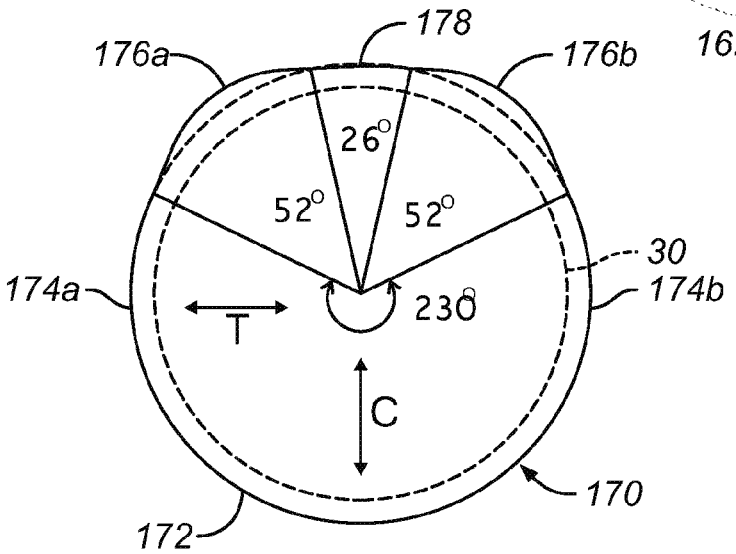
FIG. 6A diagrams a plan view of the seat's perimeter.

As with the flapper 100, the perimeter 170 of the seat's rim 160 is generally circular. In fact, as best seen in the diagram of FIG. 6A, the distal perimeter 172 extending to the transverse perimeters 174*a-b* towards ends of transverse line T (which roughly separates the rim's distal and proximal ends) conforms to a circle. However, the rim's profile from the transverse perimeters 174*a-b* to the proximal perimeter 178 deviates from circular and has outcropped lobes 176*a-b*. In the extent between these lobes 126*a-b*, the proximal perimeter 178 is generally straight and lies within the general circular profile of the rim's perimeter 170. The arcs encompassed by the distal perimeter 172 to the transverse perimeters 174*a-b*, the lobes 126*a-b*, and the straight perimeter 128 can be the same as those for the flapper 100 shown in FIG. 4A.

By making the perimeters 120/170 of the rims 110 and 160 irregular in shape, the area on the flapper's inside surface 106 can be increased, and the sealing rim 110 can be moved away from potential contact with the flow tube (30). For example, FIG. 4C shows the flow tube 30 moving relative to the flapper 100 and seat 150 shown in cross-section. As the flow tube 30 retracts through the seat 150, the end of the flow tube 30 rubs along the inside surface 106 before eventually engaging the ledge 108 and then releasing from the flapper's equalizing valve 107. The same occurs in the reverse when the flow tube 30 opens the flapper 100. This motion results in contact on an area 109 of the flapper's inside surface 106 as shown in FIG. 4D.

Protecting the flapper's rim 110 can be done without sacrificing the cross-sectional area in the tool 10. Therefore, the irregular shaped flapper 100 and seat 150 allows the components to be slimmer and take up less space in the downhole tool 10. All the same, the arrangement can operate under greater working pressure and can resist damage during harsh operations. As is known, a typical flapper used with a smaller tubing size may be restricted to lower working pressures due to potential collapse or failure of the flapper. For example, a downhole valve with a 7-in. diameter having a typical curved flapper seal may be restricted to operating in working pressures below 10-ksi. Because the irregular shape of the flapper 100 and seat 150 disclosed herein permit the flapper 100 to be slimmer, use of the flapper valve 50 with smaller tubing sizes may also be restricted to lower working pressures than desired.

Figure 7:
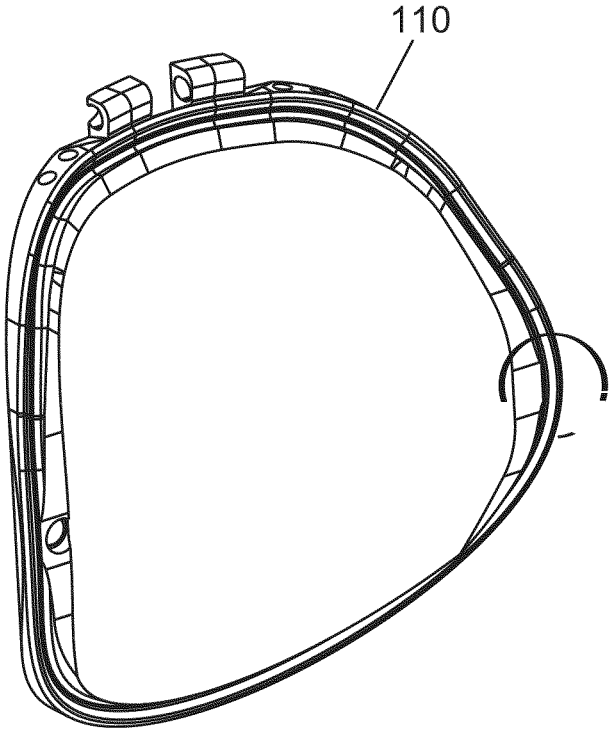
FIG. 7 is a detailed view of the sealing edge of the flapper.
Figure 9:
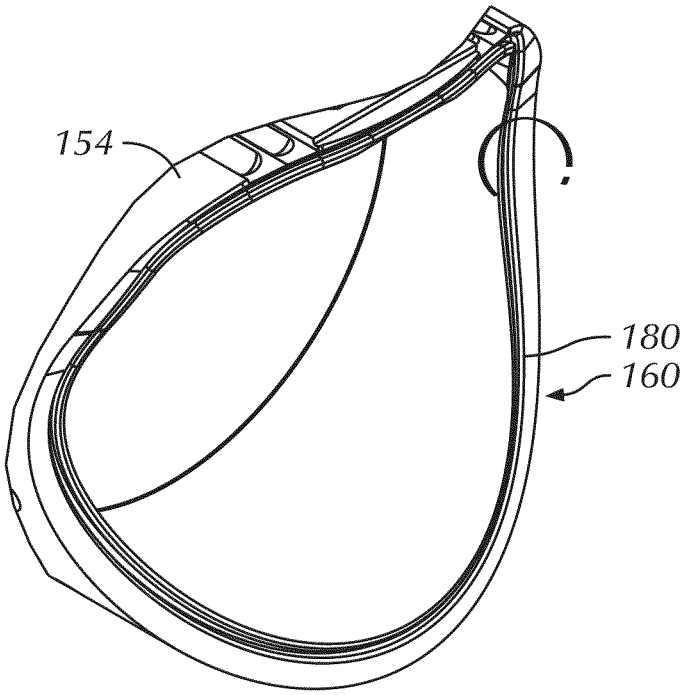
FIG. 9 is a detailed view of the sealing edge of the seat.
Figure 10A:
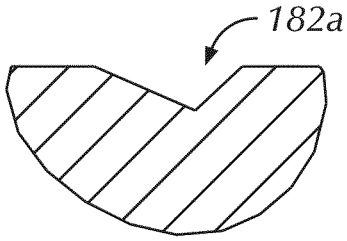
FIGS. 10A-10D show various profiles for the seat's sealing edge.
Figure 10B:
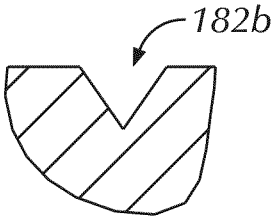
Figure 10C:
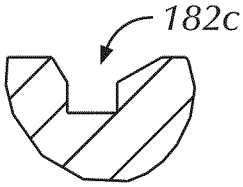
Figure 10D:
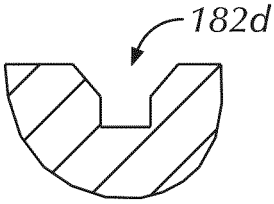

To alleviate this issue, however, the flapper valve 50 uses a groove and ridge arrangement to improve the engagement between the sealing rim 110 and seating rim 160 of the flapper 100 and seat 150. The sealing rim 110 of the flapper 100 shown in detail in FIG. 7 has a ridge or lip 130 circumscribed thereabout, and the seating rim 160 of the seat 150 shown in detail in FIG. 9 has a groove or channel 180 circumscribed thereabout.

The ridge 130 and groove 180 are preferably defined all the way around the rims 110, 160, but in other implementations they may only be partially defined around portions of the rims 110/160. Having the ridge 130 on the flapper's rim 110 may be preferred so it can be protected from flow when the flapper 100 is pivoted to an opened condition and concealed by the flow tube (30). However, the reverse arrangement can also be used. Thus, the flapper 100 can have a groove, and the seat 150 can have a ridge.

Figure 8A:
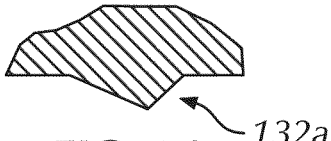
FIGS. 8A-8E show various profiles for the flapper's sealing edge.
Figure 8B:
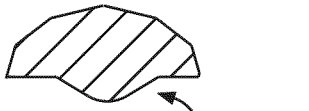
Figure 8C:
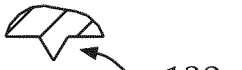
Figure 8D:
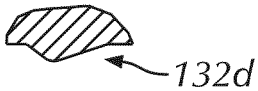
Figure 8E:
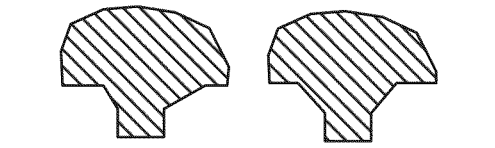

The shape of the ridge 130 and groove 180 can vary. Generally, they can be "V"-shaped, can be symmetrical or not, and can angle from 1° to 90° or more. FIGS. 8A-8E show various profiles for grooves 132*a-f*. As shown in FIGS. 8A-8D, the ridges 132*a-d* can have a triangular or "V"-shaped cross-section. Alternatively as shown in FIG. 8E, the ridges 132*e-f* can have a rectilinear cross-section, although curved and other cross-sections could be used. The ridge's tips can be pointed as in 132*a* or blunted as in 132*b*. The inside or outside edges can have the same size and angle as in 132*b* and 132*c*, or they can have different sizes or angles as in 132*a* or 132*d*. These and other possibilities could be used.

For its part, the groove 180 can be complimentary to the shape of the ridge 130. FIGS. 10A-10D show various profiles for grooves 182*a-d*. As shown, the grooves 182*a-d* can have a triangular or "V"-shaped cross-section as in 182*a-b* or rectilinear cross-section as in 182*c-d*. The grooves 182 can also have a curved or other cross-section. The groove's inner vertex can be blunted or pointed as in 182*a-b*. The inside or outside edges can have the same size and angle as in 182*b*, or they can have different sizes and angles as in 182*a*. The grooves 130 can also be rectilinear as in 182*c-d* and can have cut away lips. These and other possibilities could be used.

The various ridges 130 in FIGS. 8A-8E can be mixed or matched with the various grooves 180 in FIGS. 10A-10D. Additionally, each profile of the ridge 130 and groove 180 can be consistent around the rims 110/160, or they can change around the perimeter of the rims from one profile to another.

When the flapper 100 closes against the seat 150, the ridge 130 engages in the groove 180. This helps keep the rims 110/160 in place when sealing and enhances the seal produced between them. Moreover, the curved flapper 100 can experience forces at higher working pressures that may attempt to deform (flatten or fold) the flapper 100. Engagement between the ridge 130 and groove 180 can help reinforce the flapper 100 so it can keep its shape and resist flattening or folding. Consequently, the minimum yield strength of the flapper 100's material can be decreased while still permitting higher working pressures. Likewise, the thickness of the flapper 100 can be decreased due to the ridge and groove 130/180.

As shown in present examples, the flapper 100 is a curved type flapper rather than a flat type flapper. As such, the flapper 100 has a curved body 102 with its inside and outsides surfaces 104/106 conforming to a cylindrical contour so the flapper 100 can fit into an annular space 18 between the flow tube 30 and tool's housing when open. Yet, the teachings of the present disclosure can apply to a flapper of any shape, whether curved, flat, or a combination thereof. Therefore, the flapper 100 disclosed herein can have flat inside and outside surfaces 104/106, curved inside and outside surfaces 104/106, or a curved inside surface 106 with a flat outside surface 104 or vice versa.

For example, the flapper 100 can have a curved or flat body 102 with its inside surface 106 and its outside surface 104 being either curved or flat. In either case, the lobes 126*a-b* on the flapper 100 can help protect its sealing rim 110 when engaged by the moving flow tube 30. Likewise, the features of the ridges 130 and grooves 180 can be beneficial in either instance.

As another example, when the flapper 100 has a curved body 102 with its inside surface 106 curved and its outside surface 104 being either curved or flat, the irregular contour of the sealing and seating rims 110/160 including the transversely undulating edges and outcroppings/incroppings that deviate from the transverse undulation of the edge can be beneficial in addition to the irregular perimeter having the lobes 126*a-b*/176*a-b* and the ridges 130 and grooves 180.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole tool, comprising a housing defining a tubular bore therethrough;

a seating rim disposed about the tubular bore in the housing and having a first distal end and a first proximal end, a first planar profile of the seating rim defining a first distal perimeter at the first distal end and defining a first proximal perimeter at the first proximal end, the first proximal perimeter being asymmetrical relative to the first distal perimeter across a first centerline dividing the first distal end and the first proximal end such that the first distal perimeter has a first shape being different from a second shape of the first proximal perimeter, the first shape of the first distal perimeter conforming to a first circle, the second shape of the first proximal perimeter having first lobes disposed on either side of the first proximal end and extending outside the first circle defined by the first distal perimeter; and a flapper disposed in the housing and having a second distal end and a second proximal end, the flapper being pivotable at the second proximal end relative to the seating rim, the flapper having a sealing rim disposed about an inside surface for sealably engaging against the seating rim, a second planar profile of the sealing rim defining a second distal perimeter at the second distal end and defining a second proximal perimeter at the second proximal end, the second proximal perimeter being asymmetrical relative to the second distal perimeter across a second centerline dividing the second distal end and the second proximal end such that the second distal perimeter has a third shape being different from a fourth shape of the second proximal perimeter, the third shape of the second distal perimeter conforming to a second circle, the fourth shape of the second proximal perimeter having second lobes disposed on either side of the second proximal end of the flapper and extending outside the second circle defined by the second distal perimeter.

2. The tool of claim 1, further comprising a flow tube disposed in the tubular bore and movable relative to the seating rim and the flapper between first and second positions.

3. The tool of claim 2, further comprising:

a biasing member biasing the flow tube to the first position away from the flapper; and a piston pushing the flow tube when activated to the second position toward the flapper.

4. The tool of claim 2, wherein the flow tube in the first position permits the flapper to close transverse to the tubular bore and engage the seating rim, the second lobes protecting the sealing rim of the flapper as the inside surface engages the flow tube moving toward the first position.

5. The tool of claim 2, wherein the flow tube in the second position moves the flapper in a space between the flow tube and the tubular bore of the housing, the second lobes protecting the sealing rim of the flapper as the inside surface engages the flow tube moving toward the second position.

6. The tool of claim 2, wherein the inside surface of the flapper conforms to an outside cylindrical wall of the flow tube.

7. The tool of claim 6, wherein the flapper has an outside surface conforming to an inside cylindrical wall of the tubular bore.

8. The tool of claim 1, wherein a first elevational profile of the seating rim defines a first edge undulating transversely about the seating rim, and wherein a second elevational profile of the sealing rim defines a second edge undulating transversely about the sealing rim.

9. The tool of claim 8, wherein the first elevational profile of the seating rim defines incroppings at the first lobes, the incroppings deviating inwardly from the transverse undulation of the first edge, and wherein the second elevational profile of the sealing rim defines outcroppings at the second lobes, the outcroppings deviating outwardly from the transverse undulation of the second edge.

10. The tool of claim 8, wherein at least portions of the first edge angle outward from a center of the seating rim, and wherein at least portions of the second edge angle inward from a center of the flapper.

11. The tool of claim 1, further comprising a biasing member biasing the flapper to engage the seating rim.

12. The tool of claim 1, wherein of the sealing and seating rims comprises a groove disposed at least partially around the one rim and defined in the one rim, the other of the sealing and seating rims comprises a ridge disposed at least partially around the other rim and projecting from the other rim, the projecting ridge engaging in the defined groove when the sealing rim engages the seating rim.

13. The tool of claim 12, wherein the seating rim comprises the groove disposed at least partially on the seat around the tubular bore, and wherein the sealing rim comprises the ridge disposed at least partially around the inside surface on the flapper.

14. The tool of claim 12, wherein the groove and ridge define triangular cross-sections, rectilinear cross-sections, or a combination of cross-sections.

15. The tool of claim 12, wherein the inside surface of the flapper is curved.

16. The tool of claim 12, wherein a first elevational profile of the seating rim defines a first edge undulating transversely about the seating rim; and wherein a second elevational profile of the sealing rim defines a second edge undulating transversely about the sealing rim.

17. The tool of claim 16, wherein the first elevational profile of the seating rim defines incroppings at the first lobes, the incroppings deviating inwardly from the transverse undulation of the first edge; and wherein the second elevational profile of the sealing rim defines outcroppings at the second lobes, the outcroppings deviating outwardly from the transverse undulation of the second edge.

18. The tool of claim 16, wherein at least portions of the first edge angle outward from a center of the seating rim; and wherein at least portions of the second edge angle inward from a center of the curved flapper.

19. A flapper closure, comprising:

a seat defining a tubular bore therethrough and having a seating rim disposed thereabout, the seating rim having a first distal end and a first proximal end, a first planar profile of the seating rim defining a first distal perimeter at the first distal end and defining a first proximal perimeter at the first proximal end, the first proximal perimeter being asymmetrical relative to the first distal perimeter across a first centerline dividing the first distal end and the first proximal end such that the first distal perimeter has a first shape being different from a second shape of the first proximal perimeter, the first shape of the first distal perimeter conforming to a first circle, the second shape of the first proximal perimeter having first lobes disposed on either side of the first proximal end and extending outside the first circle defined by the first distal perimeter; and a flapper having a second distal end and a second proximal end and being pivotable at the second proximal end relative to the seat, the flapper having a sealing rim disposed about an inside surface for sealably engaging against the seating rim, a second planar profile of the sealing rim defining a second distal perimeter at the second distal end and defining a second proximal perimeter at the second proximal end, the second proximal perimeter being asymmetrical relative to the second distal perimeter across a second centerline dividing the second distal end and the second proximal end such that the second distal perimeter has a third shape being different from a fourth shape of the second proximal perimeter, the third shape of the second distal perimeter conforming to a second circle, the fourth shape of second proximal perimeter having second lobes disposed on either side of the second proximal end of the flapper and extending outside the second circle defined by the second distal perimeter.

20. The closure of claim 19, wherein one of the sealing and seating rims comprises a groove disposed at least partially around the one rim and defined in the one rim, wherein the other of the sealing and seating rims comprises a ridge disposed at least partially around the other rim and projecting from the other rim, the projecting ridge engaging in the defined groove when the sealing rim engages the seating rim.

21. The closure of claim 20, wherein the seating rim comprises the groove disposed at least partially on the seat around the tubular bore, and wherein the sealing rim comprises the ridge disposed at least partially around the inside surface on the flapper.

22. The closure of claim 20, wherein the groove and ridge define triangular cross-sections, rectilinear cross-sections, or a combination of cross-sections.

23. The closure of claim 20, wherein a first elevational profile of the seating rim defines a first edge undulating transversely about the seating rim; and wherein a second elevational profile of the sealing rim defines a second edge undulating transversely about the sealing rim.

24. The closure of claim 23, wherein the first elevational profile of the seating rim defines incroppings at the first lobes, the incroppings deviating inwardly from the transverse undulation of the first edge; and wherein the second elevational profile of the sealing rim defines outcroppings at the second lobes, the outcroppings deviating outwardly from the transverse undulation of the second edge.

25. The closure of claim 23, wherein at least portions of the first edge angle outward from a center of the seating rim; and wherein at least portions of the second edge angle inward from a center of the curved flapper.

26. The closure of claim 19, wherein a first elevational profile of the seating rim defines a first edge undulating transversely about the seating rim; and wherein a second elevational profile of the sealing rim defines a second edge undulating transversely about the sealing rim.

27. The closure of claim 26, wherein the first elevational profile the seating rim defines incroppings at the first lobes, the incroppings deviating inwardly from the transverse undulation of the first edge; and wherein the second elevational profile the sealing rim defines outcroppings at the second lobes, the outcroppings deviating outwardly from the transverse undulation of the second edge.

28. The closure of claim 26, wherein at least portions of the first edge angle outward from a center of the seating rim; and wherein at least portions of the second edge angle inward from a center of the curved flapper.

* * * * *